US005615459A

United States Patent [19]

Wu

[11] Patent Number: 5,615,459

[45] Date of Patent: Apr. 1, 1997

[54] SLIM BUCKLE MEANS FOR FIRMLY FASTENING A BELT

[76] Inventor: Teng-Sheng Wu, c/o Hung Hsing Patent Service Center P.O. Box 55-1670, Taipei, Taiwan

[21] Appl. No.: 695,645

[22] Filed: Aug. 12, 1996

[51] Int. Cl.[6] ..... A44B 11/00

[52] U.S. Cl. ..... 24/309; 24/170; 24/191

[58] Field of Search ..... 24/309, 310, 311, 24/323, 170, 171, 191, 196

[56] References Cited

U.S. PATENT DOCUMENTS

| | | | |
|---|---|---|---|
| 837,656 | 12/1906 | Baldwin | 24/309 |
| 2,108,461 | 2/1938 | Williams | 24/309 |
| 3,735,455 | 5/1973 | Hauser | 24/191 |
| 4,584,743 | 4/1986 | Calabro | 24/191 |
| 5,291,638 | 3/1994 | Huang | 24/191 |

*Primary Examiner*—Victor N. Sakran

[57] ABSTRACT

A belt buckle includes: a main plate having a bracket for passing a belt through the bracket, and a fastening member pivotally secured on the bracket of the main plate and having a clamping arm portion cut with a secant notch on the clamping arm portion for deeply engaging a free end portion of the belt with the secant notch on the clamping arm portion for firmly fastening the belt on the main plate, whereby due to the forming of the secant notch on the clamping arm portion, the thickness of the buckle may become thinner and slim for enhancing esthetic or ornamental effect of the buckle.

2 Claims, 3 Drawing Sheets

SLIM BUCKLE MEANS FOR FIRMLY FASTENING A BELT

BACKGROUND OF THE INVENTION

A conventional belt buckle as shown in FIGS. 6, 7 includes: a base plate P having a bracket H formed on the base plate P for pivotally mounting a clamping portion C of a fastening element F having a fixed end B1 of a belt B locked on the fastening element F by a pressing plate L pivotally secured on the fastening element F and having a plurality of detent teeth T1 formed on the pressing plate L for biting and locking the belt end B1 on the fastening element F, and a plurality of frictional teeth T juxtapositionally formed on an arcuate surface of the clamping portion C for frictionally detenting a free end B2 of the belt B in the bracket H of the base plate P for fastening the belt on a wearer.

However, such a conventional belt buckle has the following drawbacks:

1. If the teeth T are made too short, they will not effectively "bite" the free belt end B2, thereby losing the fastening effect of the buckle.
2. If the teeth T are made too deep in order for firmly biting the belt end B2, the thickness of the buckle will be increased to influence the ornamental effect or the esthetic appearance of the buckle.
3. For firmly securing the fixed end B1 of the belt on the fastening element F, the teeth T1 should be inserted or stuck into the belt end B1 in order to tightly "lock" the belt end on the fastening element F. However, when it is intended to trim or adjust the length of the belt, it will be very difficult to "unlock" the belt end B1 as already stuck by the teeth T1, causing inconvenience for the adjustment of the belt length.

The present inventor has found the drawbacks of a conventional belt buckle and invented the present slim buckle means for firmly fastening a belt.

SUMMARY OF THE INVENTION

The object of the present invention is to provide a belt buckle including: a main plate having a bracket for passing a belt through the bracket, and a fastening member pivotally secured on the main plate and having a clamping arm portion cut with a secant notch on the clamping arm portion for deeply engaging a free end portion of the belt with the secant notch on the clamping arm portion for firmly fastening the belt on the main plate, whereby due to the forming of the secant notch on the clamping arm portion, the thickness of the buckle may become thinner and slim for enhancing esthetic or ornamental effect of the buckle.

DETAILED DESCRIPTION

Figure 1:
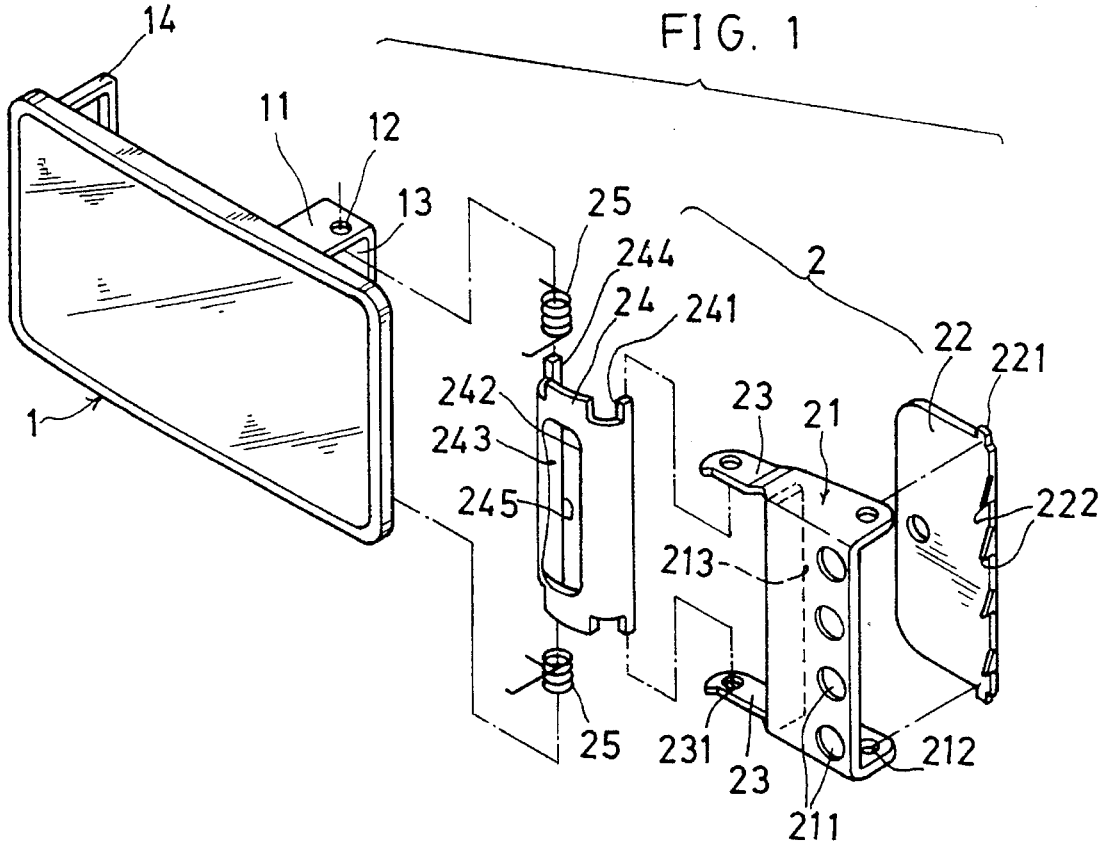
FIG. 1 is an exploded view showing the elements of the present invention.
Figure 2:
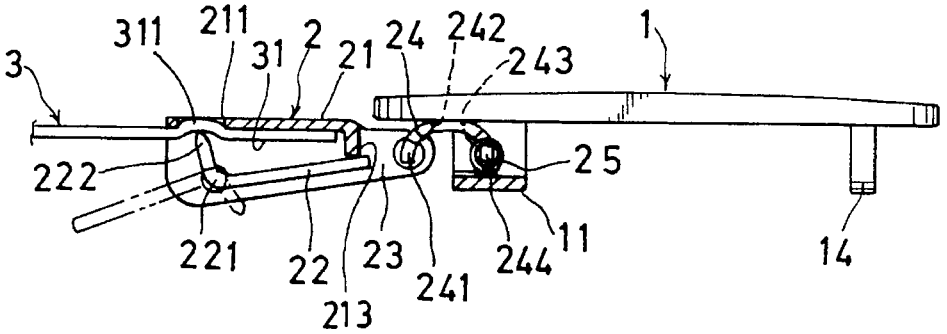
FIG. 2 is a top view illustration of the present invention when assembled.

As shown in FIGS. 1–5, the buckle means of the present invention comprises: a main plate 1, and a fastening member 2 pivotally secured to the main plate 1 for fastening a fixed end portion 31 of a belt 3 on the main plate 1 for wearing the belt 3 on a wearer's waist portion or the like. The buckle means may be made of copper or other suitable materials. The buckle means may be decorated, designed, printed or formed with any suitable decorative features or shapes, not limited in the present invention.

The main plate 1 includes: a bracket 11 generally U shaped and formed on a first side portion of the main plate 1, and a collar 14 also U shaped and formed on a second side portion of the main plate 1 for passing the belt 3 especially a free end portion 32 of the belt through a belt opening formed in the collar 14 and a belt hole 13 formed in the bracket 11. The bracket 11 is formed with a pair of pivot holes 12 therein for pivotally securing the fastening member 2 on the bracket 11 of the main plate 1.

The fastening member 2 includes: a base portion 21 having a plurality of tooth openings 211 linearly formed in an outer edge of the base portion 21, a locking element 22 having a pair of pins 221 disposed on an upper and a lower portion of the locking element 22 to be pivotally coupled with a pair of pin holes 212 formed in an upper and a lower portion of the base portion 21 and a plurality of detent teeth 222 linearly formed on an outer edge of the locking element 22 for pressing the fixed end portion 31 of the belt 3 into the tooth openings 211 in the base portion 21 for firmly securing the fixed end portion 31 of the belt in between the base portion 21 and the locking element 22 as limited by a bending edge portion 213 formed on an inner end of the base portion 21, a clamping arm portion 24 having a pair of connecting pins 241 formed on an outer edge portion of the clamping arm portion 24 for pivotally engaging a pair of pin holes 231 respectively formed in a pair of lugs 23 protruding inwardly from the base portion 21, and a pair of restoring springs 25 respectively retained on a pair of pivots 244 formed on an inner portion 245 of the clamping arm portion 24 for normally restoring the clamping arm portion 24 towards the main plate 1 for clamping the free end portion 32 of the belt in between the clamping arm portion 24 and the main plate 1.

The fixed end portion 31 of the belt 3 is bitten by the teeth 222 and is engaged in the tooth openings 211 to form a convex portion 311 on the belt end for firmly securing the belt end 31 with the fastening member 2.

The clamping arm portion 24 is formed with a secant notch 242 thereon for engaging a bitten portion 321 of the free end portion 32 of the belt 3 for firmly clamping the belt 3 as sandwiched between the clamping arm portion 24 and the main plate 1 when passing the free end portion 32 of the belt 3 through the belt hole 13 as formed in the bracket 11 of the main plate 1.

Figure 4:
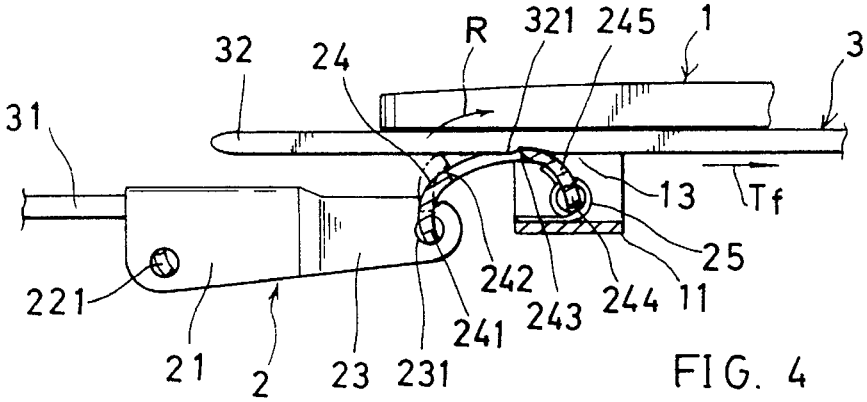
FIG. 4 is an illustration when fastening the buckle means as tensioned (Tf) by a wearer's waist portion.

The clamping arm portion 24 includes a ratchet edge portion 243 formed at an inner end of the secant notch 242 as recessed in the clamping arm portion 24 for detenting the belt 3 when clamped between the clamping arm portion 24 and the main plate 1 especially as shown in FIG. 4.

Figure 3:
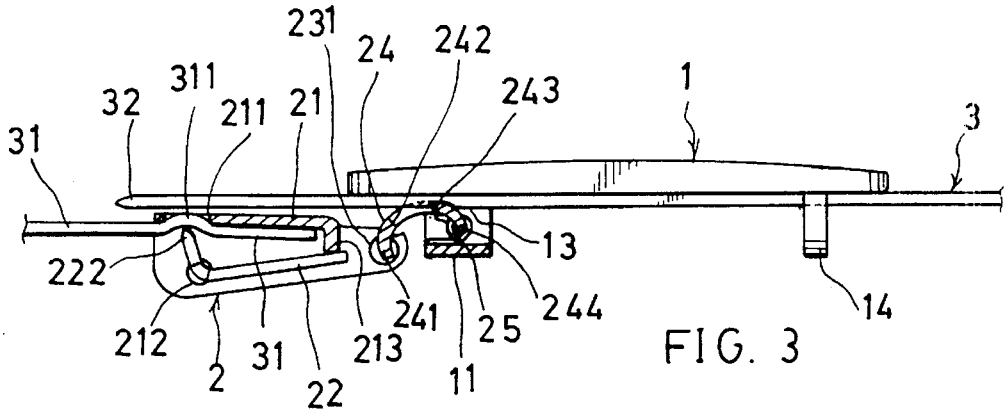
FIG. 3 is an illustration showing an initial step for fastening the buckle means of the present invention.

When using the present invention for fastening purpose, the free end portion 32 of the belt 3 is inserted through the opening or belt hole formed through the collar 14 and the bracket 11 on the main plate 1 as shown in FIG. 3. The restoring spring 25 will automatically restore the clamping arm portion 24 towards the main plate 1 to have a tendency to fasten the belt 3 in between the clamping arm portion 24 and the main plate 1.

At this time, the belt 3 is engaged with the secant notch 242 recessed on the clamping arm portion 24. When the belt 3 is tensioned (Tf) such as by a waist portion (not shown) of the belt wearer, the belt as engaged with the secant notch 242 on the clamping arm portion 24 will form a "bitten portion" 321 as bitten by an edge portion and the ratchet edge portion 243 of the clamping arm portion 24 for firmly fastening the belt between the clamping arm portion 24 and the main plate 1 as shown in FIG. 4 since the clamping arm portion 24 will be rotated in direction R about the pivots 244 for enhancing the fastening of the belt. The belt is thus deeply engaged with the secant notch 242 in the clamping arm portion 24, thereby "thinning" the thickness of the buckle means of the present invention.

Figure 5:
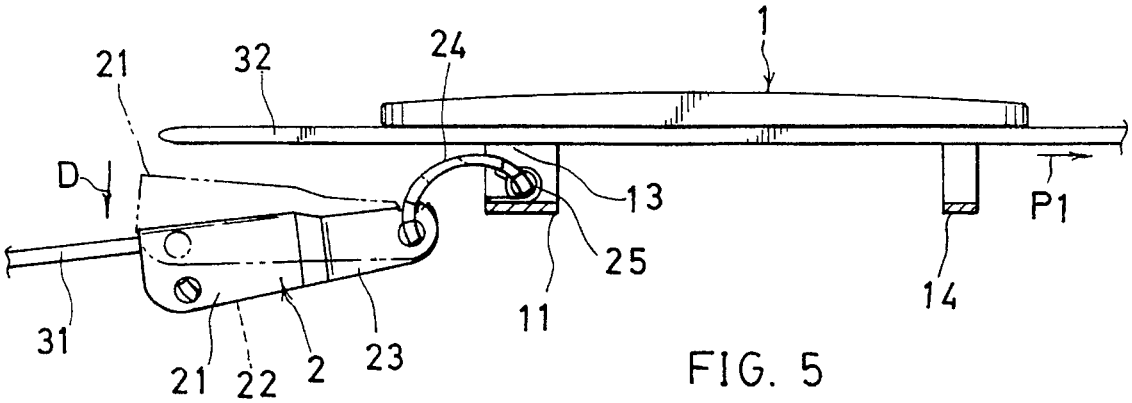
FIG. 5 shows a releasing of the present invention when depressing (D) the clamping arm portion and outwardly pulling (P1) the belt.
Figure 6:
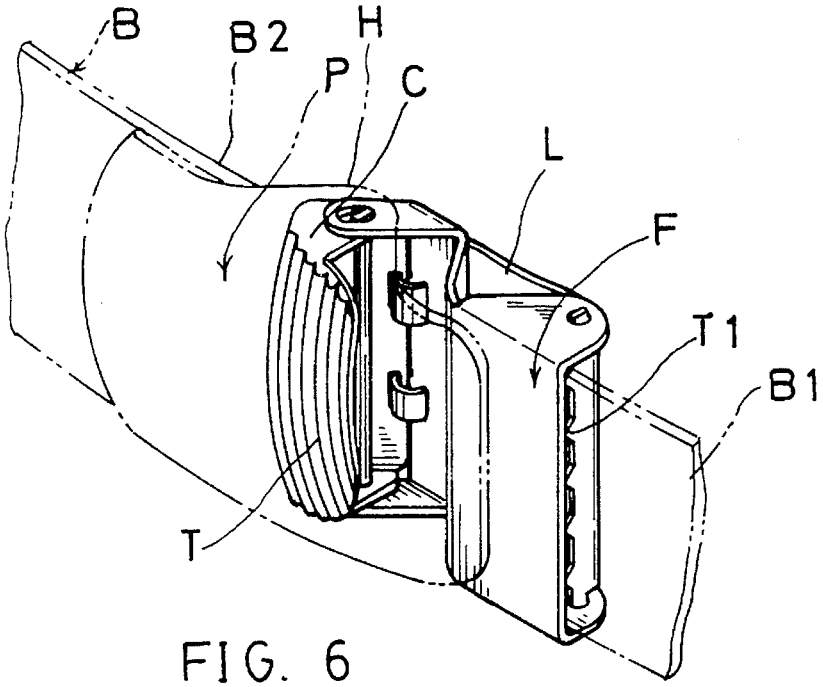
FIG. 6 PRIOR ART
FIG. 6 is a perspective view of a conventional belt buckle.

When it is intended to release the fastening of the belt, the fastening member 2 is depressed (D) as shown in FIG. 5 to bias the clamping arm portion 24 from the main plate 1 to "unlock" the belt, and upon a pulling (P1) of the belt 3 from the main plate 1, the belt 3 will then be released and taken off from the wearer.

Figure 7:
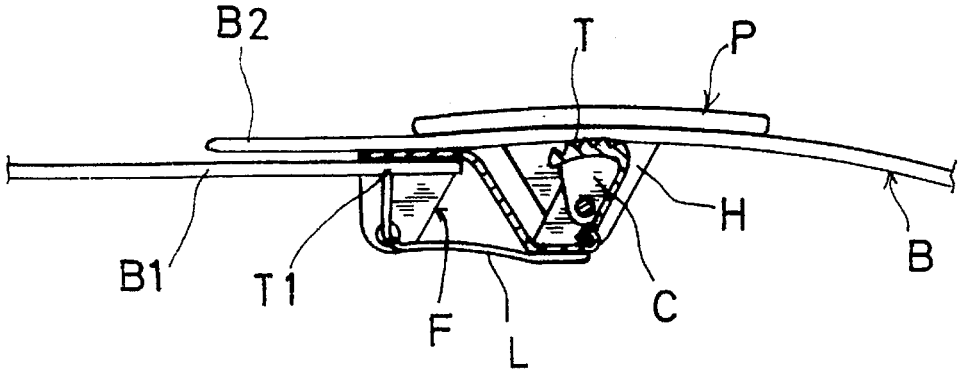
FIG. 7 PRIOR ART
FIG. 7 is a top view of the conventional buckle as shown in FIG. 6.

The present invention is superior to the conventional buckle means with the following advantages:

1. By forming the secant notch in the clamping arm portion, the belt can be deeply engaged in the secant notch for firmly fastening the belt in between the arm portion 24 and the main plate 1 without loosening. Also, the notch 242 provides a quick insertion of the belt 3 into the bracket 11 of the main plate for ergonomically wearing the belt on a wearer.
2. Since the belt is bitten into the secant notch 242 as recessed in the clamping arm portion 24, the buckle means may be made thinner and slim for better decorative or esthetic meaning.
3. The fixed end portion 31 of the belt 3 is concave in between the teeth 222 and the tooth openings 211 for a firm fixation of the belt on the fastening member 2, but also for a convenient releasing of the belt from the locking element 22 and the base portion 21 of the fastening member 2 since the teeth openings 211 provide a "buffer" space without retarding the disengagement of the teeth 222 from the belt portion 311 when releasing the belt 3 from the fastening member 2 (as compared with the conventional buckle as shown in FIG. 7).

The present invention may be modified without departing from the spirit and scope of the present invention.

I claim:

1. A buckle means comprising:

a main plate having a bracket formed on said main plate for passing a free end portion of a belt through a belt hole formed in said bracket; and a fastening member including a base portion having a plurality of tooth openings formed in an outer edge of the base portion, a locking element pivotally coupled with said base portion for securing a fixed end portion of said belt between said base portion and said locking element, a clamping arm portion having an outer portion of said arm portion pivotally secured on said base portion and having an inner portion of said arm portion pivotally secured to said bracket of said main plate, and a restoring spring normally restoring said clamping arm portion towards said main plate for fastening the free end portion of said belt in between said main plate and said clamping arm portion;

the improvement which comprises:

said clamping arm portion having a secant notch recessed in said arm portion for engaging the free end portion of said belt for firmly clamping the belt between the clamping arm portion and said main plate for reducing a thickness of said main plate, said clamping arm portion and said belt as sandwiched between said main plate and said clamping arm portion when said clamping arm portion is restored inwardly towards said main plate; and said locking element having a plurality of detent teeth formed on an outer edge portion of said locking element, and said base portion having a plurality of tooth openings formed in an outer portion of said base portion, whereby upon depression of the fixed end portion of the belt into the tooth openings in the base portion as urged by said plurality of detent teeth on said locking element, said fixed end portion of said belt is firmly secured in between said base portion and said locking element of said fastening member.

2. A buckle means according to claim 1, wherein said clamping arm portion includes a ratchet edge portion formed at an inner end of the secant notch as recessed in the clamping arm portion for detenting the belt when clamped between said clamping arm portion and said main plate.

* * * * *